US012227337B2

(12) United States Patent
Lässer et al.

(10) Patent No.: US 12,227,337 B2
(45) Date of Patent: Feb. 18, 2025

(54) CONTAINER CLOSURE

(71) Applicant: ALPLA WERKE ALWIN LEHNER GMBH & CO. KG, Hard (AT)

(72) Inventors: Franz-Michael Lässer, Lochau (AT); Werner Steurer, Doren (AT); Erwin Mayer, Eisgarn (AT); Peter Winghart, Oberstadion (DE)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 0 days.

(21) Appl. No.: 17/438,675

(22) PCT Filed: Mar. 11, 2020

(86) PCT No.: PCT/EP2020/056445

§ 371 (c)(1),
(2) Date: Sep. 13, 2021

(87) PCT Pub. No.: WO2020/182854

PCT Pub. Date: Sep. 17, 2020

(65) Prior Publication Data

US 2022/0153483 A1 May 19, 2022

(30) Foreign Application Priority Data

Mar. 11, 2019 (CH) ..... 00288/19
Apr. 16, 2019 (CH) ..... 00523/19
(Continued)

(51) Int. Cl.
*B65D 41/34* (2006.01)
*B65D 1/02* (2006.01)
*B65D 55/16* (2006.01)

(52) U.S. Cl.
CPC ..... *B65D 41/3428* (2013.01); *B65D 1/0246* (2013.01); *B65D 55/16* (2013.01)

(58) Field of Classification Search
CPC ..... B65D 41/3428; B65D 55/16; B65D 2401/30; B65D 41/3447;
(Continued)

(56) References Cited

U.S. PATENT DOCUMENTS 1,774,667 A * 9/1930 Rebichon ..... B65D 45/34 215/250
2,819,812 A * 1/1958 Freundorfer ..... B65D 51/18 220/86.1
(Continued)

FOREIGN PATENT DOCUMENTS

CN 1830730 A 9/2006
DE 9318243 U1 2/1994
(Continued)

OTHER PUBLICATIONS

International Search Report for PCT/EP2020/056445, 2 pages, mailed May 4, 2020.
(Continued)

*Primary Examiner* — Steven A. Reynolds
*Assistant Examiner* — Prince Pal
(74) *Attorney, Agent, or Firm* — MORRISS O'BRYANT COMPAGNI CANNON, PLLC

(57) ABSTRACT

A closure cap for closing the pouring opening of a container, has a cylindrical threaded part with an open edge and an inner thread to interact with an outer thread of a container neck of the container, a security ring held on a protrusion on the container neck, a plurality of security webs releasably connecting the security ring to the open edge, a first holding strip with a first end rigidly connected to an open edge of the threaded part and a second end rigidly connected to the security ring, and a second holding strip with a third end rigidly connected to an open edge of the threaded part and a fourth end rigidly connected to the security ring. The
(Continued)

second end on the circular path of the security ring is in a substantially diametrically opposed manner to the fourth end before the threaded part is opened for the first time.

25 Claims, 4 Drawing Sheets

(30) Foreign Application Priority Data

Aug. 6, 2019 (CH) ..... 00994/19
Nov. 20, 2019 (CH) ..... 01467/19
Dec. 23, 2019 (CH) ..... 01695/19

(58) Field of Classification Search
CPC ..... B65D 2251/1008; B65D 2401/35; B65D 41/34; B65D 55/165; B65D 43/16; B65D 43/164
USPC ..... 215/252, 253, 250, 258, 306, 44, 277, 215/349; 220/375, 810, 827, 829
See application file for complete search history.

(56) References Cited

U.S. PATENT DOCUMENTS 3,424,330 A * 1/1969 Henri ..... B65D 41/62 215/354
3,858,742 A * 1/1975 Grussen ..... B65D 41/485 215/253
3,887,099 A * 6/1975 Gillman ..... B65D 50/041 215/220
3,944,102 A * 3/1976 Grau ..... B65D 50/041 215/217
4,109,814 A * 8/1978 Rausing ..... B65D 41/3447 215/217
4,180,174 A * 12/1979 Quinn ..... B65D 50/048 215/217
4,206,851 A * 6/1980 Ostrowsky ..... B65D 41/3466 215/246
4,241,841 A * 12/1980 Boller ..... B65D 41/48 215/252
4,394,918 A * 7/1983 Grussen ..... B65D 41/3428 215/253
4,429,803 A * 2/1984 Butterfield ..... B65D 51/002 215/250
4,565,295 A * 1/1986 Mori ..... B65D 41/3428 215/252
4,625,875 A * 12/1986 Carr ..... B65D 41/3452 215/232
4,638,917 A * 1/1987 Persch ..... B65D 41/3414 215/252
4,666,053 A * 5/1987 Corcoran ..... B26D 9/00 215/252
4,993,569 A * 2/1991 Osip ..... B65D 51/224 215/250
5,074,425 A * 12/1991 Wustmann ..... B65D 41/3447 215/252
5,085,332 A * 2/1992 Gettig ..... B65D 55/0872 215/277
5,114,029 A * 5/1992 Gibilisco ..... B65D 50/041 215/217
5,215,204 A * 6/1993 Beck ..... B65D 55/16 215/258
5,246,124 A * 9/1993 Battegazzore ..... B65D 55/0845 215/230
5,246,125 A * 9/1993 Julian ..... B65D 41/3447 215/252
5,257,705 A * 11/1993 de Santana ..... B65D 41/3447 215/256
5,360,126 A * 11/1994 Snyder ..... B65D 41/3447 215/252
5,603,422 A * 2/1997 Herrmann ..... B65D 41/3452 215/256
5,667,086 A * 9/1997 Guerre ..... B65D 55/08 215/256
5,873,475 A * 2/1999 Volpe ..... B65D 50/068 215/250
5,944,207 A * 8/1999 Reidenbach ..... B65D 41/0471 215/237
6,029,834 A * 2/2000 Sanner ..... B65D 50/041 215/220
6,095,375 A * 8/2000 Adams ..... B65D 41/3447 222/525
6,112,923 A * 9/2000 Ma ..... B65D 41/3428 215/44
6,116,443 A * 9/2000 Parrinello ..... B65D 41/3428 215/252
6,403,173 B1 * 6/2002 Granger ..... B65D 41/0492 428/458
6,474,491 B1 * 11/2002 Benoit-Gonin ..... B65D 41/3428 220/263
6,739,466 B1 * 5/2004 Culley ..... B65D 41/3428 215/901
7,819,287 B2 * 10/2010 Suzuki ..... B05B 11/0032 215/250
7,922,018 B2 * 4/2011 Granger ..... B65D 41/045 215/349
8,181,803 B2 * 5/2012 Torrent Ortega ..... B65D 41/62 215/256
8,281,944 B2 * 10/2012 Battegazzore ..... B65D 41/3428 220/254.1
8,453,856 B2 * 6/2013 Skelton ..... B65D 41/62 215/230
8,453,857 B2 * 6/2013 Battegazzore ..... B65D 41/348 220/319
8,469,213 B2 * 6/2013 Ishii ..... B65D 41/3428 220/837
8,695,822 B2 * 4/2014 Kwon ..... B65D 55/16 215/258
9,694,948 B1 * 7/2017 Pakhomov ..... B65D 41/3409
10,124,934 B2 * 11/2018 Zeng ..... B65D 41/34
10,836,544 B2 * 11/2020 Kim ..... B65D 41/48
10,836,549 B2 * 11/2020 Maguire ..... B65D 41/3428
10,988,292 B2 * 4/2021 Giovannini ..... B65D 39/16
11,505,372 B2 * 11/2022 Bloom ..... B65D 41/3409
2001/0002661 A1 * 6/2001 Reidenbach ..... B65D 41/3447 215/252
2001/0019022 A1 * 9/2001 Nakao ..... B65D 41/3414 215/258
2002/0000420 A1 * 1/2002 Taha ..... B65D 41/0435 215/354
2002/0066713 A1 * 6/2002 Ma ..... B65D 41/3428 215/252
2002/0148803 A1 * 10/2002 Chang ..... B65D 41/3452 215/258
2003/0116522 A1 * 6/2003 Julian ..... B65D 51/20 215/349
2003/0192853 A1 * 10/2003 Zapata ..... B65D 41/3428 215/252
2004/0011757 A1 * 1/2004 Shinozaki ..... B65D 41/3452 215/252
2004/0016715 A1 * 1/2004 Strikovic ..... B65D 55/16 215/306
2004/0045926 A1 * 3/2004 Williamson ..... B65D 41/0421 215/252
2005/0005757 A1 * 1/2005 Kowal ..... B65D 41/3428 82/47
2005/0045578 A1 * 3/2005 Schwarz ..... B65D 41/3428 215/252
2005/0103740 A1 * 5/2005 Itou ..... B29C 49/071 215/41
2005/0211657 A1 * 9/2005 Mallet ..... B65D 41/3428 215/349
2005/0247662 A1 * 11/2005 Esmond ..... B65D 51/18 215/320
2005/0284837 A1 * 12/2005 Taber ..... B65D 51/145 215/276
2006/0231519 A1 * 10/2006 Py ..... B65D 51/18 220/259.3

(56) References Cited

U.S. PATENT DOCUMENTS

2007/0051691 A1* 3/2007 Hidding ..... B65D 41/045 220/258.1
2008/0179353 A1* 7/2008 Maymon ..... B65D 51/18 222/571
2008/0197100 A1* 8/2008 Faulconnier ..... B65D 41/62 215/250
2008/0251489 A1* 10/2008 Livingston ..... B01L 3/50825 215/250
2008/0264893 A1* 10/2008 Battegazzore ..... B65D 41/348 215/252
2009/0026166 A1* 1/2009 Druitt ..... B65D 41/045 215/316
2009/0114615 A1* 5/2009 Joubert ..... B65D 51/28 215/227
2009/0205506 A1* 8/2009 Lin ..... B65D 51/2878 215/250
2009/0236304 A1* 9/2009 Watson ..... G09F 3/04 215/386
2009/0236341 A1* 9/2009 McKinney ..... A47G 19/2266 220/711
2009/0289027 A1* 11/2009 Torrent Ortega ..... B65D 49/04 215/256
2009/0301987 A1* 12/2009 Luzzato ..... B65D 41/62 215/253
2010/0018940 A1* 1/2010 Granger ..... B65D 49/02 215/355
2010/0140210 A1* 6/2010 Blake ..... B65D 41/3409 215/252
2010/0258521 A1* 10/2010 Bertolaso ..... B65D 41/3438 53/484
2011/0056904 A1* 3/2011 Rozenberg ..... B65D 41/3457 215/201
2011/0114593 A1* 5/2011 Ishii ..... B65D 41/325 215/253
2011/0174760 A1* 7/2011 Luzzato ..... B65D 41/48 215/258
2011/0253666 A1* 10/2011 Keller ..... B65D 41/045 215/350
2011/0259844 A1* 10/2011 Skelton ..... B65D 55/022 215/230
2011/0297682 A1* 12/2011 Kwon ..... B65D 51/16 220/268
2012/0024815 A1* 2/2012 Kwon ..... B65D 41/3409 215/272
2012/0285921 A1* 11/2012 Kwon ..... B65D 55/16 215/243
2012/0298666 A1* 11/2012 Kwon ..... B29C 45/44 220/268
2012/0305564 A1* 12/2012 Hayashi ..... B65D 41/3428 220/288
2013/0001185 A1* 1/2013 Antier ..... B65D 55/16 215/253
2013/0276413 A1* 10/2013 Kurmis ..... B65D 41/045 53/484
2014/0263149 A1* 9/2014 Berge ..... B65D 41/3423 215/44
2016/0176586 A1* 6/2016 Mélan-Moutet ..... B65D 41/325 215/252
2017/0101227 A1* 4/2017 Aagaard ..... B29C 66/7422
2018/0086510 A1* 3/2018 Berroa Garcia ..... B65D 47/08
2018/0162605 A1* 6/2018 Zeng ..... B65D 41/32
2018/0170625 A1* 6/2018 Sung ..... B65D 41/34
2018/0201414 A1* 7/2018 Rouquette ..... B65D 41/3442
2018/0370701 A1* 12/2018 Maguire ..... B65D 41/04
2019/0009943 A1* 1/2019 Komet ..... B65D 1/0246
2019/0071222 A1* 3/2019 Druitt ..... B65D 41/34
2019/0344933 A1* 11/2019 Kim ..... B65D 55/16
2019/0344944 A1* 11/2019 Maguire ..... B65D 41/34
2020/0115115 A1* 4/2020 Migas ..... B65D 1/0246
2020/0189805 A1* 6/2020 Scherer ..... B65D 41/005
2020/0207525 A1* 7/2020 Sung ..... B65D 43/0231
2020/0369446 A1* 11/2020 Mélan-Moutet ... B65D 41/3447
2020/0399036 A1* 12/2020 Dai ..... B65D 41/325
2020/0407124 A1* 12/2020 Caszatt ..... B65D 47/0838
2021/0039840 A1* 2/2021 Benoit-Gonin .... B65D 41/3447
2021/0122532 A1* 4/2021 Dreyer ..... B65D 41/3447
2021/0155381 A1* 5/2021 Dabbur ..... B65D 41/3428
2021/0171257 A1* 6/2021 Melan-Moutet ..... B29D 1/00
2021/0221572 A1* 7/2021 Migas ..... B65D 43/163
2021/0229873 A1* 7/2021 Berroa García ... B65D 41/3447
2021/0300633 A1* 9/2021 Druitt ..... B65D 39/08
2021/0300648 A1* 9/2021 Bassi ..... B65D 41/34
2021/0316908 A1* 10/2021 Lamoureux ..... B65D 55/16
2021/0362910 A1* 11/2021 Morgan ..... B65D 55/16
2021/0371168 A1* 12/2021 Graux ..... B65D 41/3409
2022/0081171 A1* 3/2022 Erwin ..... B65D 41/3428
2022/0153480 A1* 5/2022 Mayer ..... B65D 41/3428
2022/0153483 A1* 5/2022 Lasser et al. ..... B65D 55/16
2022/0185554 A1* 6/2022 Falzoni ..... B65D 41/3447
2022/0194673 A1* 6/2022 Erwin ..... B65D 55/16
2022/0267052 A1* 8/2022 Dreyer ..... B65D 41/3447
2023/0042976 A1* 2/2023 Kainz ..... B65D 55/16

FOREIGN PATENT DOCUMENTS

EP 2308772 A1 4/2011
JP 2012201380 A 10/2012

OTHER PUBLICATIONS

Written Opinion of the International Searching Authority for PCT/EP2020/056445, 7 pages, mailed May 4, 2020.

* cited by examiner

CONTAINER CLOSURE

CROSS-REFERENCE TO RELATED APPLICATIONS

This application is a national phase entry under 37 U.S.C § 371 of PCT/EP2020/056445 filed Mar. 11, 2020, which claims priority to Swiss Patent Application No. 00288/19 filed Mar. 11, 2019, Swiss Patent Application No. 00523/19 filed Apr. 16, 2019, Swiss Patent Application No. 00994/19 filed Aug. 6, 2019, Swiss Patent Application No. 01467/19 filed Nov. 20, 2019, and Swiss Patent Application No. 01695/19 filed Dec. 23, 2019, the entirety of each of which is incorporated by this reference.

FIELD OF THE INVENTION

The invention relates to a closure cap and to a container with a closure cap.

PRIOR ART

Closure caps which are captively held on the container and close the pouring opening thereof are known from the prior art in the field of plastic closure caps having a security strip. The holding function is also important, since legal regulations are to be expected under which closures of beverage bottles must be connected captively to the beverage bottle even when in the open state.

DE 93 18 243 U1 discloses a captive closure cap of this kind for closing a container. Once the threaded part of the cap is unscrewed, it is held on the security strip by a catch band. When the closure cap is in the closed state, the catch band is integrated into the security strip. The security strip must therefore have an increased height corresponding to the sum of the height of a conventional security strip and the height of the catch band. The increased height therefore inevitably leads to increased material use when manufacturing a corresponding closure cap.

AIM OF THE INVENTION

As a result of the disadvantages of the above-described prior art, the aim of the invention is to provide a captive closure cap for which the amount of material used differs only slightly from the amount used for a conventional closure cap having a security strip.

A further aim is to disclose a captive closure cap which is especially easy to use, is self-explanatory, and is not a hindrance during any use of the container to be closed.

SUMMARY OF THE INVENTION

The aim is achieved for a closure cap for closing the pouring opening of a container by the features cited in the independent claims. The dependent claims set out developments and/or advantageous alternative embodiments.

The invention provides that the second end is arranged substantially diametrically opposite the fourth end before the first opening of the threaded part on the circular path of the security ring. The diametrical arrangement results in the first and second holding strips not necessarily having to be elastically deformed in order to be able to be transferred into the open position. Even in the open position, in which the threaded part is held on the container, the holding strips do not have to be elastically deformed or stretched. The symmetrical arrangement also makes it possible for the threaded part, after unscrewing, to be pivoted to the left or to the right into a holding position next to the pouring opening. The substantially diametrical arrangement also allows a slightly homogeneous opening of the threaded element.

In a further embodiment of the invention, before the threaded part is opened for the first time on the circular path of the security ring, the first end is arranged substantially diametrically opposite the third end. This arrangement also facilitates the positioning of the threaded element, but also the rescrewing of the threaded element onto the container neck.

In a further embodiment of the invention, prior to the first-time opening of the closure cap, the first, second, third, and fourth ends are arranged successively in ascending order on the circular path of the security ring in a counterclockwise direction when the inner thread and the outer thread are designed as right-handed threads. This arrangement of the holding strips on the open edge of the threaded part and on the security ring makes it possible for both holding strips to experience an equally large compressive load during the opening of the threaded part. None of the holding strips experiences a tensile force directed against the compressive load. At the same time, the holding strips are expanded horizontally away from the bottle neck, and any predetermined breaking webs are broken as a result of the stroke movement of the threaded part. This makes possible an easy, homogeneous opening of the closure cap with a uniform opening force. In this arrangement of the holding strips, there is also no risk of these warping or crossing over each other. The opening of the closure cap therefore does not differ or differs only insignificantly from the opening of a closure cap without holding strips.

It is expedient if the first edge is releasably connected to the open edge of the threaded part by at least one first predetermined breaking web, and the second edge is releasably connected to the security ring by at least one second predetermined breaking web, and if the third edge is releasably connected to the open edge of the threaded part by at least one third predetermined breaking web, and the fourth edge is releasably connected to the security ring by at least one fourth predetermined breaking web. As a result, the holding strips are stably held on the threaded part and the security ring. As a result, the closure cap can be pressed onto the container neck, despite the provision of two holding strips.

The first and third ends enclose a first opening angle of at least 170 degrees and at most 190 degrees, or at least 175 or at most 185 degrees, with respect to the center point of the closure cap as the apex, and that the second and fourth ends enclose a second opening angle of at least 170 degrees and at most 190 degrees, or at least 175 and at most 185 degrees, with respect to the center point of the closure cap as the apex. It is therefore conceivable for the first and second opening angles to deviate slightly from the arrangement described above, but for the second and fourth or the first and third ends of the holding strips to still be arranged substantially diametrically opposite one another. The center point of the closure cap lies in the plane between the open edge and the security ring. By selecting the first and third opening angles, the length of the first and second holding strips and their position along the security ring can be precisely determined, so that the following functions are fulfilled irrespective of which diameter the closure cap has: The first and second holding strips have a length which enables the threaded part to be unscrewed from the container neck. Moreover, the length of the holding strips allows the threaded part to be moved translationally away from the pouring opening and moved downwards along the container neck into an open position. By providing two holding strips, this movement is forced, and the threaded part is forced into an open position. In the open position, it is ensured that the threaded part does not protrude into the pouring opening when filling material is poured out.

Expediently, the first and second ends enclose a third opening angle of at least 110 degrees and at most 140 degrees, or at least 120 and at most 130 degrees, with respect to the center point of the closure cap as the apex. By selecting the third opening angle, the first holding strip has a defined length by means of which the functions stated above are made possible together with the second holding strip.

Expediently, the third and fourth ends enclose a fourth opening angle of at least 110 degrees and at most 140 degrees, or at least 120 and at most 130 degrees, with respect to the center point of the closure cap as the apex. By selecting the fourth opening angle, the second holding strip has a defined length, by means of which the functions stated above are made possible together with the second holding strip.

Since the first, second, third, and fourth opening angles have a center point of a circle as apex, their angle sum must be 360 degrees.

In a particular embodiment of the invention, the third and fourth opening angles are of equal size, as a result of which the first and second holding strips are of equal length. The same length of the first and second holding strips enables the translational, forced movement after the threaded part is unscrewed from the container neck.

In a further embodiment of the invention, the cross-section of the first and second holding strips is constant along the length of the first or second holding strip. As a result, the holding strips have constant elastic properties along their length, as a result of which a defined length of the holding strips can be determined in which the threaded part can be held on the container in a stable and wobble-free open position. In the open position, the first and second holding strips are pretensioned. The elastic pretensioning of the holding strips makes it possible for the threaded part to be unscrewed from the container neck several times and screwed onto it again, and to be reliably held several times in the open position. The constant cross-section of the holding strips along their length prevents the holding strips from being overly stretched in the open position.

The security webs may be arranged at regular intervals along the open edge. The security ring is therefore held on the threaded element in a manner sufficiently stable that the closure cap can be pushed onto the container neck. The threaded element can also be unscrewed with uniform force due to the regular intervals between the security webs.

The first, second, third, and fourth predetermined breaking webs are expediently arranged at regular intervals along the first and second or third and fourth edges. As a result, the closure cap is sufficiently stable even in the region of the first and second holding strips to be able to be pressed onto the container neck. In addition, the broken predetermined breaking webs and security webs show that the threaded part has already been twisted in relation to the container neck and is no longer originally closed.

In a further embodiment of the invention, the position of the security ring relative to the annular protrusion of the container neck can be varied in the axial direction and in the circumferential direction. Because the security ring can be displaced upwards in the axial direction, it is pulled upwards when the threaded part is unscrewed, as a result of which the first and second holding strips can be shortened and can be better adapted to the open position. As a result of the security ring simultaneously rotating when the threaded part is rotated at the beginning of unscrewing, the first and second holding strips experience an axial force and are pulled upwards when the threaded part is screwed off. The security ring may be configured to execute only a very small stroke movement (for example, 1 to 2 mm) in the axial direction, so that the predetermined breaking webs can be torn open as a result of the rotational movement or the stroke movement of the threaded part.

It has proven to be advantageous if the security ring has an anti-rotation safeguard which prevents the twisting of the security ring relative to the bottle neck when opening the threaded part when the security ring has rotated a certain distance in the circumferential direction. The anti-rotation safeguard makes it possible to strengthen the compressive force on holding strips when the threaded part is rotated in the opening direction, since they can be supported against the security ring. Since the security ring rotates with the threaded part at the beginning of rotation, the holding strips are not wound around the container neck.

A first and second recess for receiving the first and second holding strips is expediently provided on the edge of the security ring facing the holding strip. As a result, the first and second holding strips can be molded from the security ring in a space-saving manner and without additional material expenditure. For example, the first and second holding strips can be molded from the security ring by setting corresponding cuts. However, the closure cap according to the invention may be produced using an injection-molding process.

In a further embodiment of the invention, the first and/or the second ends of the first holding strip and the third and/or the fourth ends of the second holding strip can be bent along predefined bending lines. As a result, the first and second holding strips can each act as a lever with two pivot points. The bend lines also make it possible for the first and second holding strips not to be bent or bent at random positions in the open position, but rather precisely at the bend lines. As a result, the threaded part is held particularly precisely in the open position by the two holding strips and is guided exactly into the open position by the two holding strips.

It has proven to be expedient if an inwardly-projecting inner cone, e.g., in the form of a sealing cylinder or a sealing ring, is preformed on the cover plate of the threaded part and is designed to interact in a sealed manner with the inner wall of the container neck in the closed position. The closure cap can therefore act as a so-called cone sealer and reliably seals the bottle neck.

In a further embodiment of the invention, the holding strip has a width between 3 mm and 7 mm, or a width between 4 mm and 5 mm. This dimensioning has the effect that the holding strip is not unintentionally torn off—in particular, when the predetermined breaking webs are torn off. Furthermore, the closure cap does not become too high and can be joined in a sealed manner with standardized container necks having an outer thread.

The invention is also characterized in that the closure cap is designed to interact with a standardized container neck with an outer thread and annular protrusion. The closure cap can therefore be placed on standardized container necks—in particular, PET beverage bottles. Containers that are joined to the closure cap according to the invention therefore do not have to be specifically adapted to the closure cap.

The closure cap is expediently made of a plastic material—such as HDPE (high-density polyethylene) or PP (polypropylene). The closure cap can therefore be produced with standard plastic materials from which known closure caps with a security ring are also produced.

In a further embodiment of the invention, the threaded part, the security ring, the holding strips, and the at least one first and second predetermined breaking element are produced in one piece. As a result, the closure cap can be produced in an injection mold, without the need of further processing steps, to form the first and second holding strips. The inner cone may be produced in one piece together with the other parts of the closure cap.

In a particular embodiment of the invention, the security ring has slots, arranged distributed over the circumference, with an upper edge and a lower edge, wherein the upper edge is formed by a circular-arc-shaped section of the security ring, and the lower edge is formed by a wall section inclined inwardly in the radial direction, and the lower edge of each slot forms the protrusions, whereby engaging means for form-fitting engagement with the annular protrusion are formed. Since the engagement means in the form of the inwardly-inclined wall sections are not on the entire circumference of the security ring, and slots are also present by the molding of which the amount of material used is even further reduced, the material requirement of plastic can be significantly reduced by up to 5%. In addition, the wall section is immovable inwards in the radial direction, whereby the security ring is held on the annular protrusion and cannot be pulled over it until the security ring is stretched along its circumference. The security ring is rigidly held on the annular protrusion by the wall sections such that the predetermined breaking elements safely tear before the holding of the wall sections is overcome. However, the wall sections are flexible or movable outwards in the radial direction. As a result, the wall sections can be demolded from the injection mold or the injection-molding tool with little exertion of force. For the same reason, the application force for pressing the closure cap is significantly reduced in comparison to the prior art. Expansion of the security ring, which can lead to permanent damage to the closure cap, is largely prevented during demolding and pressing.

A further aspect of the invention relates to a container having a container body, a container neck adjoining the container body, an outer thread formed on the container neck, and a closure cap in accordance with the above description.

In a particular embodiment of the invention, a shoulder is formed on the container neck and is formed below the security ring or is formed by the security ring, and the length of the first and second holding strips is dimensioned such that the threaded part can be lifted from a closed position after unscrewing from the container neck and can be positioned below the shoulder in an open position, wherein the threaded part is held in the open position on the first and second holding strips, rests with the open edge at least partially on the container body, and rests against the shoulder. With the aid of the holding strips, the threaded part is pulled into the transition between the shoulder and the container body in the direction of the container neck, as a result of which a holder for the threaded part is created at the transition. By resting on the shoulder and the container body, the threaded part no longer has any freedom of movement and is therefore fixed in this open position.

Expediently, the shoulder is a support ring that is formed at the transition from the container neck to the container body. Such a support ring is already present in a plastic bottle—in particular a bottle made of PET, for technical production-related reasons. For this reason, it is particularly practical to use this support ring as a stop for the threaded element. If there is no support ring on the container, it is also possible to form a shoulder on the container neck with a length in the circumferential direction, which length enables the first cylindrical shell of the threaded part to be supported on the shoulder. It is also conceivable for the security ring to be used as a shoulder on which the first cylindrical shell can be supported.

In a further embodiment of the invention, the length of the first and second holding strips is dimensioned such that the threaded part can be lifted from a closed position after unscrewing from the container neck and can be positioned in an open position in which the cover plate rests against the outer thread and against the shoulder in the open position. The arrangement of the holding strips makes it possible for the user to select between two fixing positions or open positions, in which the threaded part releases the pouring opening and is held wobble-free on the container. The threaded part can be pivoted along a rotational axis on which the first end of the first holding strip and the third end of the second holding strip lie until the cover plate faces the container neck. The threaded part can then be braced on the container neck in that the cover plate rests against the outer thread and the support ring. In this second fixing position, the holding strips are tensioned and hold the threaded part on the container neck without wobbling.

In a further embodiment of the invention, the first and second holding strips are free of elastic deformation in the open position of the threaded part. The threaded part can be transferred from the open position into the closed position repeatedly and can consequently be repeatedly screwed onto and unscrewed from the container neck. The function of the closure cap does not abate from repeated opening and closing of the threaded element.

It has proven to be advantageous if the closure cap can be pressed onto the bottle neck. After its filling, the container can therefore be closed with the closure cap fully automatically and, accordingly, quickly and reliably.

BRIEF DESCRIPTION OF THE DRAWINGS

Further advantages and features become apparent from the following description of an exemplary embodiment of the invention with reference to the schematic representations. Shown, in a representation not true to scale, are.

DETAILED DESCRIPTION OF THE INVENTION

Figure 1:
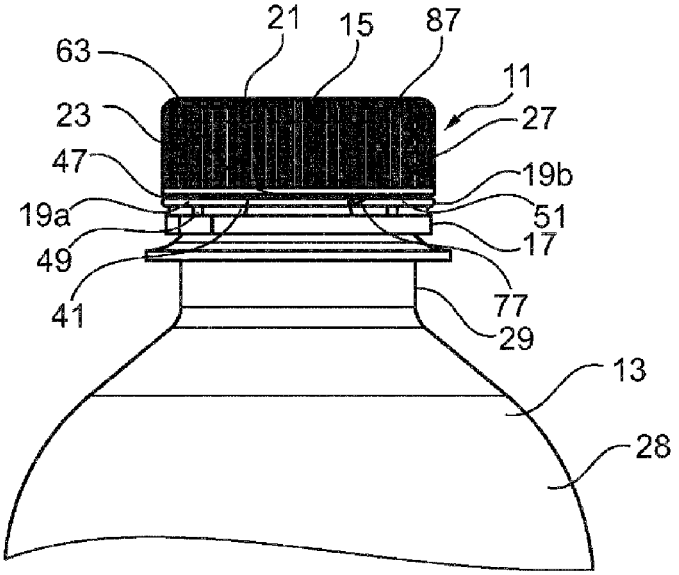
FIG. 1: a side view of an upper part of a container and a closure cap having first and second holding strips.
Figure 2:
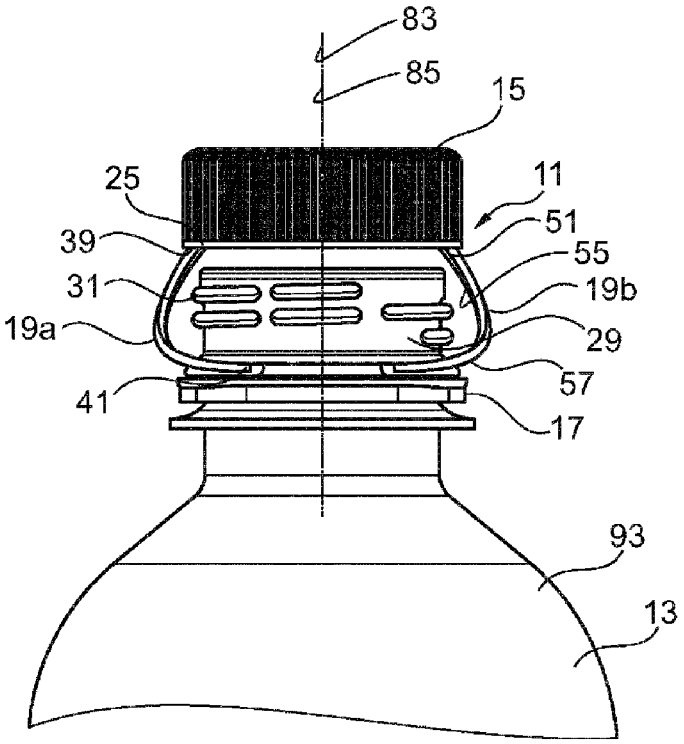
FIG. 2: a side view of the closure cap, wherein the closure cap is unscrewed from the container neck of the container.
Figure 3:
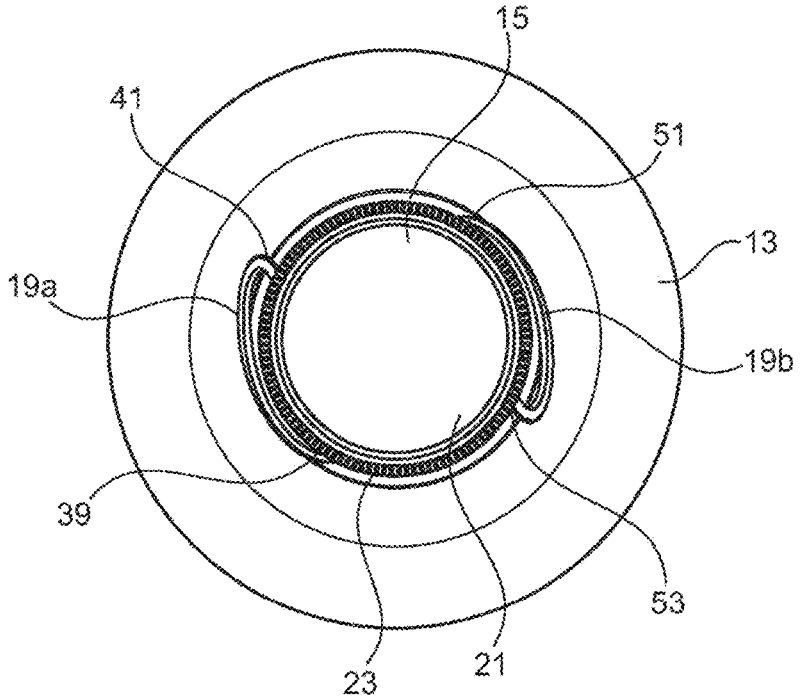
FIG. 3: the unscrewed closure cap in a plan view.

FIGS. 1 through 5 show a closure cap which is denoted as a whole by reference sign 11. The closure cap 11 is captively held on a container 13—in particular, on a bottle 13. The closure cap 11 comprises a cylindrical threaded part 15, a security ring 17, and a first and a second holding strip 19*a*, 19*b*.

The threaded part 15 comprises a cover plate 21 and a first cylindrical shell 23 having an open edge 25. An inner thread 27 is molded on the inside of the shell 23. The container 13 comprises a container body 28 and a container neck 29 adjoining the container body 28. The container neck 29 is designed as a second cylindrical shell. An outer thread 31 is molded on the container neck 29 and interacts with the inner thread 27. As a result, the threaded part 15 can be screwed onto and unscrewed from the container neck 29. The closure cap 11 closes the pouring opening 33 which is provided within the container neck 29.

The security ring 17 is held in a form fit on the container neck 13. For this purpose, an annular protrusion 35 is molded on the outside of the container neck 29 and can be engaged from below by protrusions 37 (FIGS. 6 and 7) formed on the inside of the security ring 17. The security ring 17 is rotatable relative to the container neck 29.

The first holding strip 19*a* has a first end 39 and a second end 41. The first end 39 is rigidly connected to the open edge 25. The second end 41 is rigidly connected to the security ring 17. As a result, the closure cap 11 is captively held on the container 13. Furthermore, the first holding strip 19 has a first edge 43 and a second edge 45. The first edge 43 is connected to the open edge 25 by at least one first predetermined breaking web 47, and the second edge 45 is releasably connected to the security ring 17 by at least one second predetermined breaking web 49.

The second holding strip 19*b* has a third end 51 and a fourth end 53. The third end 51 is rigidly connected to the open edge 25. The fourth end 53 is rigidly connected to the security ring 17. As a result, the closure cap 11 is additionally captively held on the container 13. Furthermore, the second holding strip 19*b* has a third edge 55 and a fourth edge 57. The third edge 55 is connected to the open edge 25 by at least one third predetermined breaking web 59, and the second edge 45 is releasably connected to the security ring 17 by at least one fourth predetermined breaking web 61.

In addition, the security ring 17 is held at the open edge 25 by a plurality of security webs 63. The security webs may be arranged at regular intervals on the security ring 17. It goes without saying that the areas which occupy the first and the second holding strips 19*a*, 19*b* on the security ring 17 are free of security webs 63 because the predetermined breaking webs 47, 49, 59, 61 acting as security webs each form a connection between the open edge 25 and the security ring 17.

The first and second holding strips 19*a*, 19*b* may have a width between 2 mm and 3 mm so that they are sufficiently stable.

Since the closure cap 11 is rotationally symmetrical, it has a center point 65. The center point 65 lies in the imaginary plane between the open edge 25 and the security ring 17.

The holding strips 19*a*, 19*b* or their ends are arranged on the security ring 17 and on the open edge so as to allow the first and second holding strips to be subjected to a compressive load when opened for the first time. For this purpose, prior to the initial opening of the closure cap 11, the first, second, third, and fourth ends 39, 41, 51, 53 are arranged successively in ascending order on the circular path of the security ring 17 in a counterclockwise direction when the inner thread 27 and the outer thread 31 are designed as right-handed threads. The second and fourth ends 41, 53 which are connected to the security strip 17, and the first and third ends 39, 51 which are connected to the threaded element 15, therefore alternate. The holding strips are thus aligned identically with respect to the direction of rotation. As already mentioned above, both holding strips 19*a*, 19*b* are subjected to a compressive load during a first opening and also during subsequent openings of the closure, because both holding strips 19*a*, 19*b* are effectively compressed as a result of the rotational movement.

As can be seen from the figures, the first and third ends 39, 51 are substantially diametrically opposed. The same applies to the second end 41 and the fourth end 53. This symmetrical arrangement of the ends of the holding strips 19*a*, 19*b* results in the threaded part 15, after being unscrewed from the container neck 29, being able to pivot as desired along the imaginary symmetry plane between the second and fourth ends 41, 53 to the one or the other side next to the spout. The threaded part 15 can thus be tilted away from the left or right in order to release the pouring opening 33. The rotational axis 83 of the container neck 29 lies on the imaginary plane of symmetry.

Figure 5:
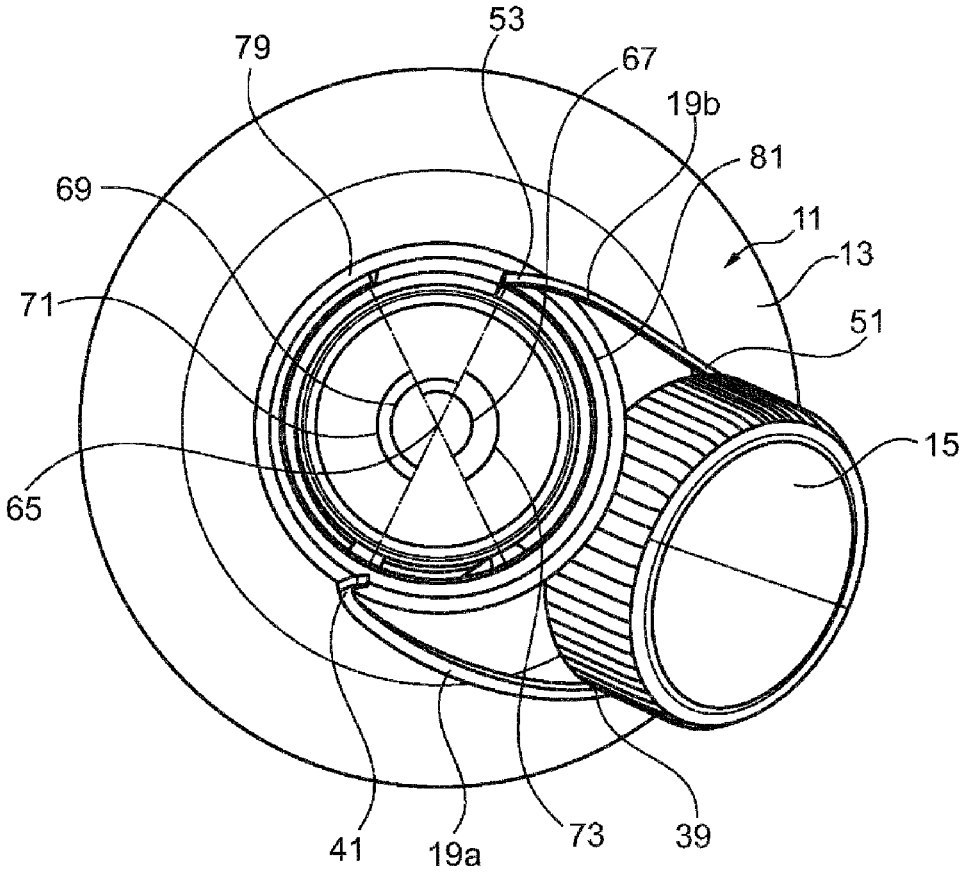
FIG. 5: a plan view of the container and the closure cap in the open position.

The following defined opening angles between the ends of the holding strips 19*a*, 19*b* are shown in FIG. 5. Since FIG. 5 shows a plan view of the closure cap 11, the opening angles can be seen particularly well. Although FIG. 5 shows that the holding strips are removed from their recesses 79, 81 on the security ring 17, the ends of the recesses are substantially identical to the ends of the holding strips. The first end 39 and the third end 51 enclose a first opening angle 67 of at least 170 degrees and at most 190 degrees, or at least 175 and at most 185 degrees, with respect to the center point 65 as the apex. The second end 41 and the fourth end 53 enclose a second opening angle 69 of at least 170 degrees and at most 190 degrees, or at least 175 and at most 185 degrees, with respect to the center point 65 as the apex.

The first end 39 and the second end 41 enclose a third opening angle 71 of at least 110 degrees and at most 140 degrees, or at least 120 and at most 130 degrees, with respect to the center point of the closure cap as the apex. The third end 51 and the fourth end 53 enclose a fourth opening angle 73 of at least 110 degrees and at most 140 degrees, or at least 120 and at most 130 degrees, with respect to the center point 65 as the apex. It goes without saying that the sum of the first, second, third, and fourth opening angles 67, 69, 71, 73 must be 360 degrees. By selecting the first, second, third, and fourth opening angles, it is possible for the first and second holding strips 19*a*, 19*b* to have a certain length which enables the functions of the closure cap described further below.

Expediently, the third and fourth opening angles 71, 73 are of equal size, which is equivalent to the first and second holding strips 19*a*, 19*b* being of equal length. The first and second holding strips 19*a*, 19*b* are carved out of the security ring 17 at an offset of 180 degrees.

A first or a second bend line 75, 77 is formed at the first or the third end 39, 51. Due to the first and second bend line 75, 77, the first and/or the third ends 39, 51 can act as a joint. Bend lines can also be provided at the second and fourth ends 41, 53.

A first and a second recess 79, 81 are provided on the security ring 17. The first and the second holding strips 19*a*, 19*b* are accommodated in the first or the second recess 79, 81. This makes it possible to produce the first and second holding strips 19*a*, 19*b* directly from the security ring 17, e.g., by cutting out of the security ring, or to provide them by, for example, an appropriate design of injection-molded shapes.

If the closure cap 11 is pressed onto the container neck 29, the pouring opening 33 is closed by the closure cap 11, and the closure cap 11 is in a closed position. When the threaded part 15 is unscrewed from the container neck 29, the first, second, third, and fourth predetermined breaking webs 47, 49, 59, 61 and the security webs 63 break. The security ring 17 rotates along with the threaded part 15. During unscrewing, the first and second holding strips 19*a*, 19*b* can straighten. In the process, the first and second ends 39, 51 can act as a joint as a result of the first and second bend lines 75, 77 (not shown). The second and fourth ends 41, 53 can also be bent, e.g., bent outwards, because the translational movement of the threaded part 15 is thereby simplified and can take place in a more defined manner.

Figure 4:
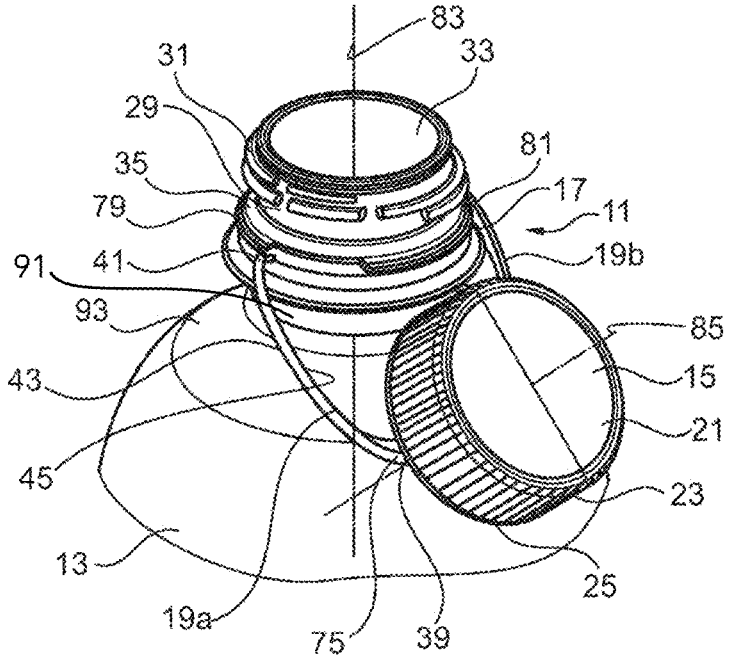
FIG. 4: a side view of the container part and the closure cap, wherein the closure cap is in an open position and is held below the container neck.

FIG. 4 shows how the threaded part 15 can be arranged on the container body 28 in the open position. On the container neck 29, a shoulder 93, which is formed below the security ring 17 or is formed by the security ring 17 itself, is formed. The shoulder is formed by a support ring 91 that is located at the transition from the container neck 29 to the container body 28. The threaded part 15 is held in the open position on the first and second holding strips 19*a*, 19*b*. FIG. 4 shows the container body 28 with a container shoulder 93. The container shoulder 93 represents the transition from the container neck 29 to the cylindrical part of the container body 28. The holding strips 19*a*, 19*b* are dimensioned in such a way that the open edge 25 can be pulled over the support ring 91 into the open position. In the open position, the threaded part 15 rests, with the open edge 25, on the surface of the container shoulder 93. The first cylindrical shell 23 rests against the support ring 91. The holding strips 19*a*, 19*b* are slightly tensioned in the open position. As a result, the threaded part 15 is pulled against the support ring 91 and is clamped below the support ring 91. The support ring 91 prevents the threaded element 15 from tilting upwards due to the pulling of the holding strips 19*a*, 19*b*. Rather, the support ring 91 causes the open edge 25 to be pressed against the container shoulder 93. As a result, the threaded part 15 is held particularly stable in the open position. It is also conceivable for the first cylindrical shell 23 to rest against the security ring 17 if there is no support ring. In this case, the security ring 17 acts as a shoulder for the threaded part 15.

As FIG. 4 shows, the axis of rotation of the container neck 83 and the axis of rotation 85 of the threaded part enclose an acute angle due to the container shoulder 93. The greater the angle, which may be at most 90 degrees, between the two axes of rotation 83, 85, the greater the tensile force on the container shoulder 93. The smaller the angle between the two axes of rotation 83, 85, the greater the tensile force on the support ring 91.

In a second manner of use (not shown), after being unscrewed from the container neck 29, the threaded part can be rotated along the first and third ends 39, 53 in such a way that the cover plate 21 is oriented in the direction of the container neck 29. Similar to what was previously explained, the threaded part can then be positioned on the container neck in such a way that the holding strips 19*a*, 19*b* pull or tension the cover plate against the outer thread 31 and the support ring 91.

Figure 6:
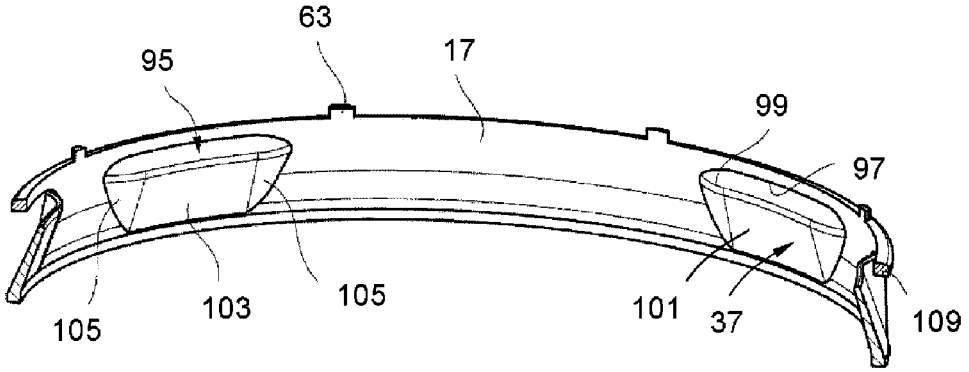
FIG. 6: a detailed view of the security ring in a further embodiment.
Figure 7:
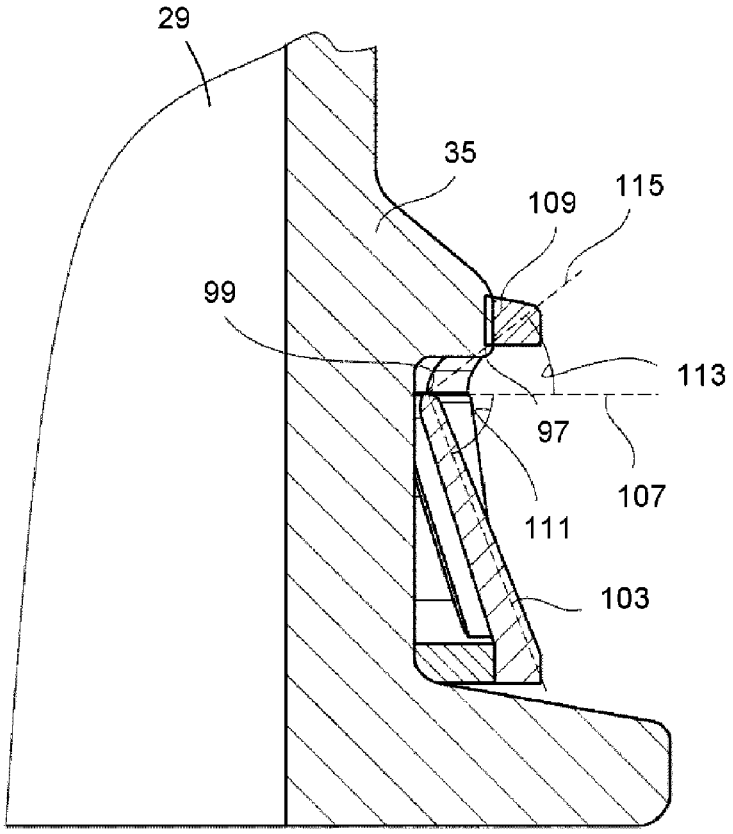
FIG. 7: a sectional view of the security ring of FIG. 6 with visualized inclination angles.

The protrusions 37 can be designed in accordance with the following description of FIGS. 6 and 7. This embodiment of the protrusions 37 is the content of the Swiss patent applications with application numbers 01467/19 and 01695/19, the priorities of which were claimed, and the disclosure contents of which are hereby incorporated into the present patent application. Slots 95 are provided in the security ring in a manner distributed over the circumference of the security ring 17. The slots 95 each have an upper edge 97 and a lower edge 99. The upper edge 97 is formed by a circular-arc-shaped section of the security ring 17. The lower edge 99 corresponds to the free edge of a wall section 101 inclined inwardly in the radial direction. Due to the internal inclination of the wall section 101, the lower edge 99 has a smaller radius than the security ring 17 and can thereby lie against an abutment (annular protrusion 35) of the container neck 29 when the threaded part 15 is unscrewed from the container neck 29. The abutment is realized by the annular protrusion 35, which is formed below the outer thread 31 on the container neck 29. When the threaded part 15 is unscrewed, the lower edge 99 engages in a form fit on the protrusion 35, as a result of which the security ring 17 is reliably held on the annular protrusion 35 even under high axial forces.

Each wall section 101 has a first subsection 103 and two second subsections 105. The first subsection 103 represents an inwardly-folded shell section and is designed to be flat. The second subsections 105 adjoin the inwardly-facing sides of the first subsection 103 and connect them to the security ring 17. The second subsections 105 can be designed curved or flat and inwardly face each other at an angle. The lower edge 99 of the slot 95 corresponds to the free edges of the first subsection 103 and of the second subsections 105 and lies in a plane 107, which is shown in FIG. 7. The plane 107 is oriented to be perpendicular to the axis of rotation 85 of the container neck 29. These described design features of the wall section 101 have the advantage that the wall section 101, with the entire lower edge 99, can rest against the annular protrusion 35 and not yield upwards in the event of an axial tensile force. As a result, the security ring 17 is held non-releasably against the protrusion 35 or can be removed from the protrusion 35 only by being destroyed. A movement of the first subsection 103 inwards in the radial direction is prevented by provision of the second subsections 105. However, a movement of the first subsection 103 outwards in the radial direction is possible. This movement is flexible, and, after being pressed radially outwards, the wall section 101 returns to its inwardly-inclined home position. This has the further advantage that the security ring 17 can be easily demolded and can be pressed together with the threaded part 15 onto the container neck 29 with little force. As a result of the flexibility of the wall section 101, the demolding from an injection mold and the pressing onto the container neck 29 can take place without the risk of damaging the wall section 101.

The inclined wall sections 101 have a lesser wall thickness than the remaining security ring 17. FIG. 7 shows that the region of the lower edge 99 has the smallest wall thickness. The above-described flexibility of the wall section 101 radially outwards is thereby further improved. The wall thickness of the wall section 101 increases linearly downwards starting from the lower edge 99.

FIGS. 6 and 7 show the security ring 17 without the threaded part 15. FIGS. 6 and 7 clearly show that an annular bead 109 on which the upper edges 97 rest is formed above the slots 95 on the security ring 17.

FIG. 7 shows a first and second inclination angle 111, 113. The first inclination angle 111 indicates the inclination of the first subsection 103 with respect to the plane of the lower edge 99. The first inclination angle 111 has a magnitude between 60 and 80 degrees, or between 65 and 75 degrees. The greater the first inclination angle 111, the better the stability of the wall sections 101 with respect to vertical force effects or axial tensile forces caused by the unscrewing of the threaded part 15. However, the first inclination angle 111 may not become too large, since otherwise the annular protrusion 35 cannot be sufficiently engaged.

The second inclination angle 113 indicates the inclination of the slot 95 with respect to the plane of the lower edge 109. The connecting line 115, which represents the inclination of the slot 95, is a connection of the upper edge 97 to the lower edge 99 in a plane spanned by the axis of rotation 85 and the connecting line 115. The second inclination angle 113 is enclosed by the connecting line 115 and the plane 107. The second inclination angle 113 has a magnitude between 30 and 50 degrees, or between 35 and 45 degrees. The greater the second inclination angle 113, the easier the security ring 17 can be demolded.

An inwardly-projecting inner cone 87 (FIG. 1), e.g., in the form of a sealing cylinder or a sealing ring, is formed on the cover plate 21 of the threaded part 15. The inner cone 87 is designed to interact in a sealed manner with the inner wall 89 of the container neck 29 in the closed position. The closure cap 11 can therefore act as a so-called cone sealer and reliably seals the container neck 29.

The closure cap 11 is made of a plastic. Such plastics may include inter alia PP and HDPE.

The invention claimed is:

1. Closure cap for closing the pouring opening of a container, comprising:

a cylindrical threaded part having an open edge and an inner thread, configured to interact with the outer thread of a container neck of the container, a security ring configured to be held on an annular protrusion on the container neck, a plurality of security webs releasably connecting the security ring to the open edge, a first holding strip having a first end and a second end and a first edge and second edge, wherein the first end is rigidly connected to the open edge of the threaded part, and the second end is rigidly connected to the security ring, and a second holding strip having a third end and a fourth end and a third edge and fourth edge, wherein the third end is rigidly connected to the open edge of the threaded part, and the fourth end is rigidly connected to the security ring, wherein the second end is arranged on a circular path of the security ring substantially diametrically opposite the fourth end before the threaded part is opened for a first time, and wherein in the closed state of the threaded part, the first and the third ends enclose a first opening angle of at least 170 degrees and at most 190 degrees, or at least 175 and at most 185 degrees, with respect to the center point of the closure cap as an apex, and the second and the fourth ends enclose a second opening angle of at least 170 degrees and at most 190 degrees, or at least 175 and at most 185 degrees, with respect to the center point of the closure cap as the apex.

2. Closure cap according to claim 1, wherein the first end is arranged on the circular path of the security ring substantially diametrically opposite the third end before the threaded part is opened for the first time.

3. Closure cap according to claim 1, wherein before the first opening of the closure cap, the first, second, third, and fourth ends are arranged successively in ascending order on the circular path of the security ring in a counterclockwise direction when the inner thread and the outer thread are configured as right-handed threads.

4. Closure cap according to claim 1, wherein the first edge is releasably connected to the open edge of the threaded part by at least one first predetermined breaking web, and the second edge is releasably connected to the security ring by at least one second predetermined breaking web, and the third edge is releasably connected to the open edge of the threaded part by at least one third predetermined breaking web, and the fourth edge is releasably connected to the security ring by at least one fourth predetermined breaking web.

5. Closure cap according to claim 1, wherein the first and second ends enclose a third opening angle of at least 110 degrees and at most 140 degrees, and preferably of at least 120 and at most 130 degrees, with respect to the center point of the closure cap as the apex.

6. Closure cap according to claim 5, wherein the third and fourth ends enclose a fourth opening angle of at least 110 degrees and at most 140 degrees, and preferably of at least 120 and at most 130 degrees, with respect to the center point of the closure cap as the apex.

7. Closure cap according to claim 6, wherein the third and fourth opening angles are equally large, whereby the first and second holding strips are equally long.

8. Closure cap according to claim 1, wherein a cross-section of the first and second holding strips is constant along a respective length of the first or second holding strip.

9. Closure cap according to claim 1, wherein the security webs are arranged at regular intervals along the open edge.

10. Closure cap according to claim 4, wherein the first, second, third, and fourth predetermined breaking webs are arranged at regular intervals along the first and second or the third and fourth edges.

11. Closure cap according to claim 1, wherein a position of the security ring relative to the annular protrusion of the container neck can be changed in an axial direction and in a circumferential direction.

12. Closure cap according to claim 1, further comprising a first and second recess for receiving the first and second holding strips on an edge of the security ring facing the first and second holding strips.

13. Closure cap according to claim 1, wherein the first and/or the second end of the first holding strip and the third and/or the fourth end of the second holding strip can be bent along predefined bend lines.

14. Closure cap according to claim 1, wherein an inwardly-projecting inner cone, in the form of a sealing cylinder or a sealing ring, is formed on a cover plate of the threaded part and is configured to interact in a sealed manner with an inner wall of the container neck in the closed position.

15. Closure cap according to claim 1, wherein the first and second holding strips have a width between 3 mm and 7 mm, or a width between 4 mm and 5 mm.

16. Closure cap according to claim 1, wherein the closure cap is configured to interact with a standardized container neck with an outer thread and annular protrusion.

17. Closure cap according to claim 1, wherein the closure cap is comprised of a plastic material.

18. Closure cap according to claim 4, wherein the threaded part, the security ring, the first and second holding strips, the plurality of security webs, and the at least first, second, third, and fourth predetermined breaking webs are produced in one piece.

19. Closure cap according to claim 1, wherein the security ring comprises a plurality of slots distributed over its circumference, with an upper edge and a lower edge, wherein the upper edge is formed by a circular-arc-shaped section of the security ring, and the lower edge is formed by a wall section inclined inwardly in the radial direction, the lower edge of each slot forms a plurality of protrusions for engagement in a form-fitting manner with the annular protrusion.

20. A container comprising:

a container body, a container neck adjoining the container body, an outer thread formed on the container neck, a closure cap for closing a pouring opening provided within the container neck, the closure cap comprising a cylindrical threaded part having an open edge and an inner thread, which can interact with the outer thread of a container neck of the container, a security ring designed to be held on a protrusion molded on the container neck, a plurality of security webs, which releasably connect the security ring to the open edge, a first holding strip having a first and a second end and a first and second edge, wherein the first end is rigidly connected to the open edge of the threaded part, the second end is rigidly connected to the security ring, the first edge is releasably connected to the open edge of the threaded part by at least one first predetermined breaking web, and the second edge is releasably connected to the security ring by at least one second predetermined breaking web, and a second holding strip having a third end and a fourth end and a third edge and fourth edge, wherein the third end is rigidly connected to the open edge of the threaded part, and the fourth end is rigidly connected to the security ring, wherein the second end is arranged on a circular path of the security ring substantially diametrically opposite the fourth end before the threaded part is opened for a first time, and wherein in the closed state of the threaded part, the first and the third ends enclose a first opening angle of at least 170 degrees and at most 190 degrees, or at least 175 and at most 185 degrees, with respect to the center point of the closure cap as an apex, and the second and the fourth ends enclose a second opening angle of at least 170 degrees and at most 190 degrees, or at least 175 and at most 185 degrees, with respect to the center point of the closure cap as the apex.

21. Container according to claim 20, further comprising a shoulder formed on the container neck below the security ring or formed by the security ring, a length of the first and second holding strips dimensioned such that the threaded part can be lifted from a closed position after unscrewing from the container neck and can be positioned below the shoulder in an open position, wherein the threaded part is held in the open position on the first and second holding strips, rests with the open edge at least partially on the container body, and rests against the shoulder.

22. Container according to claim 21, wherein the shoulder comprises a support ring formed at a transition from the container neck to the container body.

23. Container according to claim 21, wherein the length of the first and second holding strips is dimensioned such that the threaded part can be lifted from a closed position after unscrewing from the container neck and can be positioned in an open position in which a cover plate rests against the outer thread and against the shoulder in the open position.

24. Container according to claim 23, wherein in the open position of the threaded part, the first and the second holding strips are free of elastic deformation.

25. Container according to claim 20, wherein the closure cap is configured to be pressed onto the bottle neck.

* * * * *